United States Patent [19]

Renard et al.

[11] Patent Number: 4,579,628

[45] Date of Patent: Apr. 1, 1986

[54] PROCESS FOR CHLORINE BLEACHING OF KRAFT PULP USING A SULFITE EXTRACTION STAGE

[75] Inventors: Jean J. Renard, Georgetown, S.C.; Shyam S. Bhattacharjee, Monroe, N.Y.

[73] Assignee: International Paper Company, New York, N.Y.

[21] Appl. No.: 734,251

[22] Filed: May 14, 1985

Related U.S. Application Data

[63] Continuation of Ser. No. 546,263, Oct. 28, 1983, abandoned.

[51] Int. Cl.[4] ..... D21C 9/12; D21C 9/14

[52] U.S. Cl. ..... 162/85; 162/86; 162/88; 162/89

[58] Field of Search ..... 162/85, 86, 88, 89, 162/83, 90, 84, 76, 72, 77

U.S. PATENT DOCUMENTS

| | | | |
|---|---|---|---|
| 1,645,061 | 10/1927 | Kress | 162/83 |
| 1,828,338 | 10/1931 | Neumann | 162/87 |
| 3,695,995 | 3/1972 | Roymoulik | 162/65 |
| 3,720,577 | 3/1973 | Roymoulik | 162/65 |
| 4,119,486 | 10/1978 | Eckert | 162/65 |
| 4,292,216 | 9/1981 | Grunewald et al. | 260/175 |

[56] References Cited

FOREIGN PATENT DOCUMENTS

| | | | |
|---|---|---|---|
| 537738 | 3/1957 | Canada | 162/89 |
| 523971 | 3/1972 | U.S.S.R. | 162/85 |

OTHER PUBLICATIONS

Histed; *Pulp and Paper Canada;* "Bleachery Simplification in CIP"; vol. 81, No. 11, pp. 54–58, 11–1980.

Richter; *TAPPI,* vol. 38, No. 3, "Production of High Alpha-Cellulose Wood Pulps and Their Properties", 3–1955, pp. 129–150.

Singh, "The Bleaching of Pulp", pp. 82–100, Standard Press Inc., Atlanta, Ga., 1979.

Liebergott et al. Reports of 69th Annual Meeting, Tech. Section Canadian Pulp and Paper Assoc. Montreal 1982, page A41.

*Primary Examiner*—Steve Alvo

*Attorney, Agent, or Firm*—Jay S. Cinamon; Royal E. Bright

[57] ABSTRACT

Extraction of chlorine bleached kraft wood pulps with aqueous peracids at pH values of 7 or below, aqueous sulfites at pH values below 10 or with certain non-aqueous solvents provides extracted pulps having lower residual color and permits use of lesser quantities of alkali or chlorine dioxide in subsequent bleach steps to attain brightness and strength levels comparable to those attained with pulps treated by alkaline extraction at pH values of 10 or higher. At a comparable level of alkali and chlorine dioxide or hypochlorite application, extraction of chlorinated pulp with peracids provides bleached pulps with enhanced brightness.

6 Claims, No Drawings

PROCESS FOR CHLORINE BLEACHING OF KRAFT PULP USING A SULFITE EXTRACTION STAGE

This application is a continuation of application Ser. No. 546,263, filed Oct. 28, 1983, now abandoned.

BACKGROUND OF THE INVENTION

This invention relates to the art of chemical pulping and bleaching of wood pulp, particularly the art of removal, by chemical means, of residual lignin remaining in wood pulp produced by chemical pulping processes, more specifically use of chlorine to remove residual lignin from or bleach wood pulp produced by sulfate or "kraft" pulping processes.

The conventional classical multistage chlorine and chlorine dioxide based bleaching sequence for kraft pulp is one wherein the unbleached kraft pulp is treated with chlorine, conveniently in the presence of a small quantity of a viscosity preserving agent, such as chlorine dioxide, then extracted with aqueous alkali at high pH values, conveniently greater than pH 10, followed by treatment with either hypoclorite followed by chlorine dioxide or chlorine dioxide alone, a second strong caustic extraction and a second chlorine dioxide treatment. These sequences are conventionally represented as $C_D$EHDED and $C_D$EDED wherein C represents the treatment with chlorine; H represents treatment with hypochlorite; D represents treatment with chlorine dioxide and E represents extraction at pH values greater than 10 with aqueous alkali. Thus, for example, $C_D$ represents treatment with chlorine in the presence of chlorine dioxide.

Extraction of the chlorinated lignin in the first alkaline extraction stage in the above sequence results in substantial darkening of the pulp compared to the color of pulp at the end of the chlorination stage and a substantial amount of the chemicals employed in subsequent stages are necessary simply to remove the color added by the alkaline extraction.

The use of caustic soda as the alkali in the extraction stages of multistage chlorine based bleaching has long been traditional because it was efficient in removing the reaction products of lignin and chlorine or chlorine dioxide and because it was readily available and relatively inexpensive, being the coproduct of the manufacture of chlorine from brine. The industrial use of chlorine has been declining in recent years and, therefore, the price of caustic soda has risen while the supply has declined to the point where occasional shortages have occurred. Efforts to find alternatives for caustic soda in the bleaching field have, to the inventors knowledge, been limited to the investigation of alternative alkalis capable of providing aqueous solutions of high pH values. Illustrative of these studies is one by Liebergott et. al. reported in Reports in the 69th Annual Meeting, Technical Section, Canadian Pulp and Paper Association, Montreal, 1982, p. A41. which examines a number of alkalis as potential substitutes for caustic soda in the chlorine bleaching process and which reaffirms that caustic soda is the best, that alternative alkalis can be employed and that all work better when the pH values are higher.

The present invention provides alternative extraction methods and reagents, principally in the first extraction step, for chlorinated lignin which minimize darkening of pulp during extraction or permit use of less chemicals to reach brightness levels comparable to those attainable with the conventional treatment, or which permit the attainment of higher brightness levels with equivalent chemical usage than those produced by conventional treatment. The invention also surprisingly shows that the particular aqueous extractants contemplated are effective at pH values lower than those taught as necessary by the prior art.

DISCUSSION OF RELEVANT ART

U.S. Pat. No. 1,645,061 represents an early attempt to develop a suitable bleaching process for kraft pulps. This patent attempts to employ a two-stage sequence involving a treatment with hypochlorite bleaching powder avoiding acid pH followed by treatment with bisulfite solution under conditions where loss of material is minimal. The bisulfite is actually employed as an anti-chlor to destroy remaining chlorine chemicals. Use of chlorine or chlorine dioxide bleaching stages are not mentioned and in that era use of chlorine dioxide particularly was not even contemplated as it was not commercially available. The present invention employs chlorine at acid pH values and intends to cause delignification, hence, material is lost from the pulp.

U.S. Pat. No. 1,828,338 represents another early attempt to use hypochlorite bleaching powder to bleach kraft pulp. In this process the unbleached pulp is first treated with an alkaline perborate solution and then hypochlorite in the presence of oxalic acid and NaCl. Once again chlorine or chlorine dioxide treatment stages are not suggested or otherwise contemplated.

U.S. Pat. Nos. 3,695,995 and 3,720,577 illustrate the use of peracetic acid as the second stage in bleaching processes employing oxygen or chlorine dioxide as the oxidant in the first stage. Since the object of both patents is to replace the elemental chlorine bleaching process for kraft pulp, use of peracetic acid in connection with a chlorine bleaching process is not suggested or taught.

U.S. Pat. No. 4,119,486 teaches the use of cationic surfactants in an ozonated oxygen bleaching process for kraft pulp. That it does not teach ways of replacing the alkaline extraction stage in a chlorine bleaching process is self-evident.

SUMMARY OF THE INVENTION

The invention provides a process for bleaching kraft pulp comprising:

(a) treating an aqueous slurry of kraft wood pulp with a bleaching effective amount of chlorine and a cellulose protective amount of chlorine dioxide;

(b) treating the chlorine and chlorine dioxide treated pulp of step (a) above with an effective amount of a chlorinated lignin solubilizing agent selected from the group consisting of aqueous solutions of lower alkanoic peracids, aqueous solutions of sulfites, and liquid nonaqueous solvents selected from di-lower alkyl ethers, lower alkanols, lower alkylene polyols, liquid aromatic compounds, liquid lower alkyls substituted with cyano, nitro, fluoro, chloro, bromo or mixtures thereof, liquid cycloalkanes, liquid cycloalkanes having one or more carbon atoms replaced by oxygen, sulfur or nitrogen, lower alkanoyl amides or di-lower alkyl ketones.

The tangible embodiments produced by the process of the invention possess the inherent applied use properties of being pulps suitable for forming sheets of paper or paperboard having improved brightness over comparable pulps bleached with chlorine in the presence of a cellulose protective amount of chlorine dioxide and then extracted with aqueous alkali at pH values above 10. Thus, further bleaching to high brightness values may be performed employing a lesser quantity of chemicals than otherwise would be required. In addition, chlorolignin recovered from non-aqueous chlorolignin solvents may be employed as a base for the manufacture of adhesives for gluing cellulose materials such as wood, plywood, particle-board and the like. U.S. Pat. No. 4,292,216 is illustrative of glues based on chlorolignin.

Special mention is made of embodiments of the invention wherein further bleaching is continued by sequences comprising:

(a) treatment with hypochlorite followed by treatment with chlorine dioxide, extraction with aqueous alkali and a final treatment with chlorine dioxide;

(b) treatment with chlorine dioxide, extraction with aqueous alkali and a final treatment with chlorine dioxide;

(c) treatment with hypochlorite, followed by treatment with chlorine dioxide, extraction with a chlorinated lignin solubilizing agent as defined herein above, and a final treatment with a chlorine dioxide; and (d) treatment with chlorine dioxide, extraction with a chlorinated lignin solubilizing agent as hereinabove defined and a final treatment with chlorine dioxide.

Special mention is also made of preferred embodiments of the invention wherein the chlorinated lignin solubilizing agent is an aqueous solution of a lower alkanoic peracid and most preferably wherein the lower alkanoic acid is peracetic acid. Special mention is also made of preferred embodiments of the invention wherein the chlorinated lignin solubilizing agent is an aqueous solution of sulfite ion, most preferably an aqueous solution of sulfite ion having a pH value of from about 3.0 to about 10.0.

Special mention is also made of particular embodiments of the invention wherein the chlorinated lignin solubilizing agent is a liquid non-aqueous solvent as defined hereinabove, preferably one wherein the liquid non-aqueous solvent is a liquid cycloalkane having one or more carbon atoms replaced by oxygen, sulfur or nitrogen, most preferably one wherein the said cycloalkane comprises tetrahydrofuran or sulfolane.

DESCRIPTION OF THE PREFERRED EMBODIMENT

The manner of practicing the process of the invention to produce specific embodiments thereof will now be illustrated with references to a process for extraction of chlorinated white pine kraft pulp of starting Kappa No. 30 to 32 with aqueous solutions of sulfite ion.

White pine pulped by standard sulfate (kraft) pulping techniques to a Kappa number of about 30 to about 32 may be treated in standard fashion with chlorine in the presence of chlorine dioxide, conveniently by treating an about 3% consistency slurry of white pine kraft pulp of about 30 to 32 Kappa number with chlorine at a solution concentration of about 6.7% by weight in the presence of chlorine dioxide at a cellulose protective solution concentration of about 0.1% by weight at slightly elevated temperature, conveniently at about 30° C., for a short period of time, conveniently about one hour. After the chlorine-chlorine dioxide treatment the pulp may be separated from the treatment solution by standard means, such as filtration and washed with water to remove residual water soluble treatment chemicals and treatment products in the usual way. The washed pulp may then be treated, as an about 10% consistency slurry, with about 3% by weight in solution of sodium bisulfite at alkaline pH, conveniently about pH 8 at the beginning of treatment, at moderately elevated temperature, conveniently about 70° C., for a moderate period of time, conveniently for about one and one half hours. Following the aforementioned treatment, the pulp may again be separated from the treatment solution by conventional means, such as filtration, and washed to remove residual treatment chemicals and water soluble reaction products.

At this stage, the pulp, which has a brightness higher than pulp similarly treated but subjected to a conventional alkaline extraction rather than extraction with sodium bisulfite solution, may be formed into paper by conventional means or it may be further bleached or brightened by conventional bleaching techniques, such as one or more chlorine dioxide treatment steps, interspersed with any desired conventional washings and extractions of chlorine dioxide reaction products from the pulp with aqueous alkali or the chloro-lignin solubilizing agents of this invention. The amount of later stage bleaching chemicals required to reach a specific brightness level will be less than the amount of chemicals required to reach the same brightness level starting with a pulp which has been subjected to conventional alkaline extraction after initial chlorine treatment.

In addition to the sodium bisulfite illustrated hereinabove as a chlorolignin solubilizing agent, other chlorolignin solubilizing agents contemplated by the invention include other alkali metal sulfites and bisulfites in aqueous solutions having pH values ranging from about 3 to about 9. Also suitable are lower alkanoic peracids or water soluble salts of such peracids, preferably peracetic acid and its salts in aqueous solutions having pH values ranging from about 3 to about 7 and various various liquid nonaqueous solvents selected from the group consisting of di-lower alkylethers, such as diethyl ether and di-isopropyl ether, lower alkanols, such as methanol, ethanol, normal and isopropanol, lower alkylene polyols, such as ethylene glycol, glycerol, hexamethylene glycol, liquid aromatic compounds, such as benzene, toluene, xylene, pyridine, thiophene, liquid lower alkyls substituted with cyano, nitro, fluoro, chloro, bromo or mixtures thereof, such as acetonitrile, nitroethane, perfluorokerosene, hexachloroethane, tetrabromo ethane, cycloalkanes, such as cyclohexane, cyclopentane, methyl cyclohexane, cycloalkanes having one or more carbon atoms replaced by oxygen, sulfur or nitrogen, such as tetrahydrofuran, piperidine, sulfolane, tetrahydro thiophene, lower alkanoyl amides, such as acetamide, di-lower alkyl ketones, such as acetone, methylethylketone and mixtures thereof. Extraction with peracetic acid may be followed with a mild alkaline extraction, from about pH 8.0 to about pH 11.0 for further enhancement of delignification.

As used herein and in the appended claims, the term bleaching effective amount of chlorine means from about 6% by weight to about 9% by weight, preferably from about 7% by weight, to about 8% by weight, the term cellulose protective amount of chlorine dioxide means from about 0.1% by weight to about 0.5% by weight, preferably from about 0.1% by weight to about 0.2% by weight, the term effective amount of a chlorinated lignin solubilizing agent means from about 1.9% by weight to about 7.6% by weight of sulfite ion, preferably from about 1.9% by weight to about 3.3% by weight of sulfite ion, from about 0.16% by weight to about 4.0% by weight of —$CO_3H$ radical, preferably from about 0.2% by weight to about 0.6% by weight of —$CO_3H$ radical, that is, for example, from about 0.2% by weight to about 5.0% by weight of peracetic acid, preferably from about 0.25% by weight to about 0.75% by weight peracetic acid, or for liquid non-aqueous solvents from about 1 liter per 100 g oven dry pulp at about a 33% consistency to about 2 liter. The term effective amount of chlorine dioxide means from about 1.0% by weight to about 3.0% by weight, preferably from about 1.5% by weight to about 2.0% by weight, the term effective amount of sodium hyprochlorite means from about 1.5% by weight to about 2.5% by weight, preferably from about 1.7% by weight to about 2.0% by weight, the term effective amount of an aqueous solution of an alkali metal hydroxide means from about 3% by weight to about 6.0% by weight NaOH, preferably from about 3.5% by weight to about 4.5% by weight NaOH. The above weight % effective amounts and cellulose protective amounts are stated on an oven dry pulp basis. It will be understood by one of skill in the art that in the bleaching sequences described herein and in the appended claims, a conventional water wash between each specifically enumerated separate stage is contemplated unless the context specifically requires otherwise.

The following examples further illustrate the best mode contemplated by the inventors for the practice of their invention.

In the following examples unless specifically stated otherwise white pine (softwood) kraft pulps of 30 to 32 Kappa number were the pulp species employed. After the indicated treatment of the chlorinated pulps the pulps were then washed with water and further bleached by a DED sequence.

Unless specifically stated otherwise the following conditions were employed for $C_D$EDED bleaching and also for $C_DE_{(modified)}$DED bleaching with all bulk quantities by weight $C_D$ Stage: $Cl_2$=0.225×Kappa No., $ClO_2$=0.1%, 3% Pulp Consistency, 30° C., 1 hour $E_1$ Stage: 3.5% NaOH, 10% Pulp Consistency, 70° C., 1.5 hr.

$D_1$ Stage: 1.5% $ClO_2$, 10% Pulp Consistency, 60° C., 3 hr.

$E_2$ Stage: 0.6% NaOH, 10% Pulp Consistency, 70° C., 1.5 hr.

$D_2$ Stage: 0.5 $ClO_2$, 10% Pulp Consistency, 60° C., 3 hr., $SO_2/H_2O$ wash

From the above it will be apparent that in general when employed to represent the stages in a bleaching sequence, "$C_D$" represents a pulp treatment step wherein the pulp is treated with an aqueous solution of chlorine in the presence of a minor amount of chlorine dioxide as a viscosity preserver, "E" represents a pulp treatment step wherein the pulp is treated with aqueous alkali to solubilize and remove aqueous alkali soluble materials formed as a result of a prior treatment step; "D" represents a treatment of pulp with aqueous chlorine dioxide, and "$E_{(modified)}$" represents a treatment of the pulp with one of the chlorinated lignin solubilizing agents contemplated by this invention.

EXAMPLE 1

All softwood pulps or softwood pulps containing some northern hardwood pulp as indicated in Table 1, after treatment in the $C_D$ stage were extracted at 70° C. for 1.5 hr employing 3% solutions of sodium sulfite, sodium bisulfite, or $SO_2$ at the various starting and finishing pH levels shown in Table 1. The results are tabulated in Table 1. It will be noted that in certain cases chlorination was performed in the absence of chlorine dioxide. The results on pulp viscosity are apparent.

Properties of handsheets formed according to TAPPI procedue T-205 om 81 from certain of the pulps of Table 1 are shown in Table 2.

TABLE 1

| BLEACHING SEQUENCE/ MODIFICATION IN EXTRACTION STAGE* | PERMANGANATE NO. | | | BRIGHTNESS (REVERTED), % GE | | | | VISCOSITY, cP | |
|---|---|---|---|---|---|---|---|---|---|
| | $E_1$ | $E_2$ | FINAL | $E_1$ | $E_2$ | FINAL | | $E_2$ | FINAL |
| (A) Starting Pulp: SWD, 29.8 Kappa | | | | | | | | | |
| 1. $C_D$EDED: control 1s + E, Ph 12/11 | 4.4 | 0.7 | 0.1 | 39.1 | 76.4 | 89.5 | (88.0) | — | 26.8 |
| 2. $C_DE_S$DED: sulfite, pH 7/5 | 5.9 | 1.0 | 0.1 | 47.3 | 70.7 | 89.6 | (86.8) | — | 26.1 |
| 3. $C_DE_S$DED: sulfite, pH 8/7 | 4.8 | 1.0 | 0.1 | 44.2 | 72.3 | 88.7 | (86.8) | — | 26.0 |
| 4. $C_DE_SDE_S$D: sulfite, pH 7/5 | 5.0 | 1.2 | 0.9 | 46.5 | 76.7 | 90.0 | (86.3) | — | 18.0 |
| (B) Starting Pulp: 70% SWD & 30% HWD 25.4 Kappa | | | | | | | | | |
| 1. $C_D$EDED: control | 3.0 | 0.7 | 0.5 | 41.8 | 76.4 | 89.1 | (87.0) | — | 23.8 |
| 2. $C_DE_S$DED: sulfite, pH 7/4 | 3.9 | 1.2 | 1.0 | 48.0 | 70.5 | 87.9 | (85.0) | — | 17.4 |
| 3. $C_DE_S$DED: sulfite, no wash between C & E, pH 6/3 | 6.9 | — | 0.9 | 40.8 | 60.2 | 83.5 | (78.7) | — | 18.5 |
| 4. C($SO_2$)DED: no wash after C stage | 9.2 | — | 0.7 | 37.5 | 54.5 | 80.3 | (77.3) | — | 15.0 |
| 5. $CE_S$DED: bisulfite, pH 5/2 | 4.2 | 1.2 | 0.9 | 47.8 | 69.9 | 88.5 | (85.5) | — | 12.1 |
| (C) Starting Pulp: SWD, 32.8 Kappa | | | | | | | | | |
| 1. CEDED: control | 3.4 | 1.1 | 0.5 | 37.2 | 76.5 | 88.2 | (86.6) | 24.4 | — |

TABLE 1-continued

| BLEACHING SEQUENCE/ MODIFICATION IN EXTRACTION STAGE* | PERMANGANATE NO. | | | BRIGHTNESS (REVERTED), % GE | | | | VISCOSITY, cP | |
|---|---|---|---|---|---|---|---|---|---|
| | $E_1$ | $E_2$ | FINAL | $E_1$ | $E_2$ | FINAL | | $E_2$ | FINAL |
| 2. $CE_SDED$: sulfite, pH 9/7 | 3.7 | 1.2 | 1.0 | 42.2 | 71.6 | 87.4 | (84.6) | 24.7 | — |
| 3. $CE_SDE_SD$: sulfite, pH 9/7 | 3.6 | 1.2 | 0.8 | 41.5 | 70.5 | 86.4 | (83.4) | 26.4 | — |
| 4. $C_DEDED$: control | 3.2 | 1.0 | 0.6 | 39.0 | 78.1 | 88.6 | (86.6) | 30.6 | — |
| 5. $C_DE_SDE_SD$: sulfite, pH 9/7 | 3.9 | 1.0 | 0.9 | 42.3 | 69.9 | 87.5 | (84.1) | 31.0 | — |

Notes for Table 1
*E - 3.5% NaOH.
$E_S$ - 3% $Na_2SO_3$ or $NaHSO_3$, approximately 0.8% NaOH added when pH 8-9.

EXAMPLE 2

The effects of varying the concentration of sulfite, pH, time temperature and pulp consistency compared to standard controls is shown in Table 3.

TABLE 3

| | $C_DE_SDED$ | | | | | | $C_DEDED$ | |
|---|---|---|---|---|---|---|---|---|
| | 1 | 2 | 3* | 4* | 5 | 6 | 7 | 8 |
| First Extraction | | | | | | | | |
| $Na_2SO_3$ Applied, (%) | 3 | 6 | 12 | 12 | 12 | 12 | — | — |
| NaOH Applied, (%) | 0.2 | — | — | — | — | — | 3.5 | 3.5 |
| Pulp Consistency, (%) | 10 | 10 | 4 | 4 | 4 | 4 | 10 | 10 |
| Temp, (°C.) | 70 | 90 | 110 | 125 | 150 | 175 | 70 | 70 |
| Time, min | 90 | 90 | 60 | 60 | 60 | 60 | 90 | 90 |
| Initial/ Final pH | 7.1/4.6 | 7.5/7.0 | 7.8/6.2 | 7.8/6.2 | 7.8/6.0 | 7.8/5.6 | 12/11 | 12/11 |
| Permanganate No. | 5.9 | 5.7 | 3.2 | 2.6 | 2.1 | 1.4 | 3.0 | 3.0 |
| Brightness, (% GE) | 47 | 44 | 45 | 48 | 49 | 48 | 38 | 38 |
| First Dioxide | | | | | | | | |
| $ClO_2$ Applied, (%) | 1.5 | | 1.0 | | 1.0 | 0.5 | 0.5 | 1.0 |
| $ClO_2$ Consumed, (%) | 93 | | 77 | | 68 | 70 | 100 | 86 |
| Second Extraction | | | | | | | | |
| Permanganate No. | 1.0 | | | | 0.7 | 0.4 | 0.8 | 0.5 |
| Brightness, (% GE) | 71 | | 77.6 | | 78 | 81 | 67 | 77 |
| Second Dioxide | | | | | | | | |
| $ClO_2$ Applied, (%) | 0.5 | | 0.5 | | 0.5 | 0.5 | 0.5 | 0.5 |
| $ClO_2$ Consumed, (%) | 65 | | | 53 | 45 | 40 | 86 | 80 |
| Brightness, (% GE) | 89.6 | | | 89.6 | 88.4 | 89.3 | 86.5 | 88.6 |
| Reverted Brightness, (% GE) | 86.8 | | | 86.9 | 86.0 | 86.3 | 83.2 | 85.9 |
| Viscosity, (cP) | 26.1 | | | 20.5 | 18.6 | 14.8 | 28.7 | 24.4 |

Notes for Table 3
*Pulps in examples 3 and 4 were combined after the 1st extraction stage and then bleached by DED stages.

TABLE 2

| BLEACHING SEQUENCE | BRIGHTNESS % GE | VISCOSITY cP | HANDSHEET PROPERTIES | | | |
|---|---|---|---|---|---|---|
| | | | BL, km | BF | TF | CSF, ml |
| (A*) 1. $C_DEDED$ | 89.5 | 26.8 | 12.7 | 103.8 | 87.9 | 475 |
| 2. $C_DE_SDED$ | 89.6 | 26.1 | 13.7 | 100.2 | 89.7 | 450 |
| 4. $C_DE_SDE_SD$ | 90.0 | 18.0 | 12.9 | 93.4 | 82.5 | 420 |
| (B*) 1. CEDED | 89.1 | 23.8 | 11.6 | 83.4 | 91.7 | 375 |
| 2. $CE_SDED$ | 87.9 | 17.4 | 11.4 | 81.7 | 86.0 | 390 |

Notes for Table 2
*Starting Pulp A and B as in Table 1
BL = Breaking length (TAPPI procedure T-404)
BF = Burst Factor (TAPPI procedure T-403)
TF = Tear Factor (TAPPI procedure T-414)
CSF = Canadian Standard Freeness (Technical Section, Canadian Pulp and Paper Assoc. procedure Cl)

EXAMPLE 3

Softwood pulps are bleached employing an aqueous solution of peracetic acid (Pa) in place of the aqueous alkali (E) employed in a normal $C_DEDED$ bleaching sequence. That is, a $C_DPaDED$ sequence is employed. Standard $C_DEDED$ bleaching sequences are run on similar pulps. The conditions employed and the results are shown in Table 4.

TABLE 4

| TRIAL No. | | | | | | $E_1$/Pa STAGE PROPERTIES P No. | BRIGHTNESS, % GE |
|---|---|---|---|---|---|---|---|
| 1a | Control $E_1$ (3.5% NaOH) | | | | | 3.0 | 37.6 |
| 1b | Control $E_1$ (3.5% NaOH) | | | | | 3.0 | 37.6 |
| | PERACETIC ACID TREATMENT OF $C_D$ PULP | | | | | | |
| | % Pa (CONSUMED) | % NaOH | pH INITIAL/ FINAL | TEMP, °C. | WASHING/ EXTRACTION | | |
| 2a | 0.5 (0.25) | None | 3.2/2.8 | 50 | Hot Water (75–80° C.) Wash (HWW) Further wash with $Na_2CO_3$ sol. (0.1%) | 5.4 | 45.7 |
| 2b | 0.5 (0.40) | 0.5 | 4.0/3.0 | 50 | HWW | 5.5 | 46.6 |
| 3a | 0.5 (0.23) | None | 3.2/2.5 | 77 | HWW | 5.7 | 44.0 |
| 3b | 0.5 (0.44) | 0.5 | 4.2/2.8 | 77 | HWW | 5.0 | 45.0 |
| 3c | 0.5 (0.43) | 1.0 | 4.3/3.3 | 77 | HWW | 4.0 | 48.2 |
| 3d | 0.5 (0.5) | 2.0 | 6.5/4.5 | 77 | HWW | 2.8 | 51.5 |
| 3e | 0.5 (0.5) | 2.0 | 6.5/4.5 | 77 | HWW | 2.8 | 51.5 |
| 3f | 0.5 (0.5) | 2.0 | 6.5/4.5 | 77 | Alk. Extr. (1% NaOH) | 2.0 | — |
| 3g | 0.5 (0.5) | 2.0 | 6.5/4.5 | 77 | Alk. Extr (1% NaOH) | 2.0 | — |
| 4a | 0.25 (0.25) | 2.0 | 6.6/5.0 | 77 | HWW | 4.0 | 40.5 |
| 4b | 0.25 (0.25) | 2.0 | 6.6/5.0 | 77 | HWW | 4.0 | 40.5 |

| TRIAL NO. | $D_1E_2$ STAGE PROPERTIES % $ClO_2$ | P No. | BRIGHTNESS, % GE | VISCOSITY, cP | FINAL ($D_2$) PROPERTIES P No.* | Brightness % GE (REVERTED) | VISCOSITY, cP |
|---|---|---|---|---|---|---|---|
| 1a | 1.0 | 0.5 | 76.9 | — | 0.3 | 88.6 (85.9) | 24.4 |
| 1b | 0.5 | 0.8 | 66.7 | — | 0.3 | 86.5 (83.2) | 28.7 |
| 2a | 1.0 | 1.4 | 61.2 | — | 0.5 | 87.1 (84.2) | 19.8 |
| 2b | 1.0 | 1.6 | 60.5 | — | — | 86.2 (83.2) | 20.4 |
| 3a | 1.0 | 1.2 | 62.5 | 13.1 | — | — | — |
| 3b | 1.0 | 1.1 | 65.5 | 17.9 | — | — | — |
| 3c | 1.0 | 1.0 | 68.3 | 23.4 | — | 87.6 (85.2) | 20.1 |
| 3d | 1.0 | — | 72.1 | — | 0.3 | 89.0 (85.6) | 22.5 |
| 3e | 0.5 | — | 67.2 | — | 0.5 | 87.7 (83.6) | 22.3 |
| 3f | 0.5 | 0.8 | 75.9 | 27.9 | — | 88.2 (86.3) | 23.8 |
| 3g | 0.25 | 1.0 | 74.0 | 28.8 | — | 87.6 (85.5) | 24.2 |
| 4a | 1.0 | 1.2 | 67.5 | 28.1 | 0.6 | 88.3 (85.7) | 23.7 |
| 4b | 0.5 | 1.8 | 57.7 | — | 0.6 | 85.4 (82.5) | 29.2 |

Note for Table 4
*Permanganate Number

EXAMPLE 4

Pulps are bleached as shown in Table 5. The conditions employed and the results obtained are also tabulated in Table 5.

TABLE 5

| SEQUENCE | TEST NO. | CHLORINATION TEMP, °C. | TOTAL $ClO_2$ APPLIED, % | PULP PROPERTIES T/$E_1$ STAGE BRIGHTNESS, % GE | P No. | 2nd E STAGE BRIGHTNESS, % GE | P No. | FINAL STAGE BRIGHTNESS, % GE (REV) | VISCOSITY (cP) |
|---|---|---|---|---|---|---|---|---|---|
| $C_D$TDED* | 1 | 30 | 1.5 | | 5.9 | 49.6 | 2.7 | 81 | |
| $C_D$TDED | 2 | 30 | 2.0 | | | 57.5 | 1.8 | 85.4 (82.1) | 22.6 |
| $C_D$TDED | 3 | 55 | 2.0 | 42 | | 62.5 | 1.3 | 88.6 (86.1) | 21.7 |
| Conventional $C_D$EDED | 4 | 30 | 1.5 | 38 | | 76.0 | 0.8 | 88.6 (86.0) | 24.0 |
| Conventional | 5 | 55 | 2.0 | 42 | | 77.4 | 0.5 | 90.2 | 25.0 |

TABLE 5-continued

| SEQUENCE | TEST NO. | CHLORINATION TEMP, °C. | TOTAL $ClO_2$ APPLIED, % | PULP PROPERTIES: T/$E_1$ STAGE BRIGHTNESS, % GE | P No. | 2nd E STAGE BRIGHTNESS, % GE | P No. | FINAL STAGE BRIGHTNESS, % GE (REV) | VISCOSITY (cP) |
|---|---|---|---|---|---|---|---|---|---|
| $C_D$EDED | | | | | | | | | |

Note for Table 5
*T = Tetrahydrofuran (THF) extraction at 30° C., 21 THF/100 g pulp (oven dry basis) at 33% consistency.

EXAMPLE 5

A comparison is made of strength properties of handsheets made from pulps bleached as illustrated in the prior examples.

The bleaching sequences and the results are tabulated in Table 6.

TABLE 6

| BLEACHING* SEQUENCE | BRIGHTNESS, % GE | VISCOSITY, cP | HANDSHEET PROPERTIES (400 CSF) BL, km | BF | TF |
|---|---|---|---|---|---|
| $C_D$EDED | 88.6 | 24.4 | 11.9 | 93.3 | 81.0 |
| $C_D$PaDED | 87.1 | 19.8 | 10.8 | 89.4 | 72.0 |
| $C_D$PaDED | 88.3 | 23.7 | 12.2 | 91.7 | 84.7 |
| $C_DE_SDED$** (a) | 89.6 | 20.5 | 11.2 | 82.0 | 80.0 |
| $C_DE_SDE_SD$** (b) | 90.0 | 18.0 | 12.9 | 93.4 | 82.5 |
| $C_D$TDED | 88.6 | 21.7 | 10.7 | 91.0 | 77.0 |

Notes for Table 6
*E - with NaOH
$E_S$ - Extraction with $Na_2SO_3$
Pa - Extraction with peracetic acid
T - Extraction with tetrahydrofuran
**Sulfite treatment at 110–125° C. in (a) and at 70° in (b)

EXAMPLE 6

Northern softwood kraft pulp of kappa No. 29 is bleached by the sequences and under the conditions shown in Table 7. The results found are tabulated therein.

TABLE 7

| STAGE | BRIGHTNESS, % GE (reverted) $E_1$ | $E_2$ | Final | P No. $E_1$ | VISCOSITY cP Final |
|---|---|---|---|---|---|
| (1) $C_D$EDED (Control) $D_1$ = 1% $ClO_2$, $D_2$ = 0.5% $ClO_2$ $E_1$ 3.5% NaOH | 36.5 | 77.4 | 87.0 (85.2) | 3.7 | 24.5 |
| (2) $C_D$PaEDED | 48.1 | 74.8 | 87.0 | 2.5 | 22.7 |

TABLE 7-continued

| STAGE | BRIGHTNESS, % GE (reverted) $E_1$ | $E_2$ | Final | P No. $E_1$ | VISCOSITY cP Final |
|---|---|---|---|---|---|
| Pa; 0.5% Pa, 2% NaOH, 77° C., 90 min. pH = 6.4/4.6 $E_1$; 1.5% NaOH, 70° C., 30 min $D_1$ = 0.25% $ClO_2$, $D_2$ = 0.50% $ClO_2$ | | | (85.2) | | |
| (3) $C_D$PaEDED PaE; as in #2 above $D_1$ = 0.5% $ClO_2$, $D_2$ = 0.25% | 48.4 | 79.8 | 87.5 | 2.7 (85.0) | 22.3 |
| (4) $C_D$PaEDED Pa; as above #2 & 3 $E_1$; 3% NaOH, 70° C. 60 min $D_1$ = 0.5% $ClO_2$, $D_2$ = 0.25% $ClO_2$ | 48.5 | 78.3 | 87.5 (86.0) | 2.6 | 22.3 |

EXAMPLE 7

Northern softwood kraft pulp was bleached employing the sequences shown in table 8 under the conditions specified therein. The results tabulated in table 8 illustrate that extraction of chlorine bleached Kraft wood pulps with aqueous peracetic acid at pH7 or below with aqueous sulfite at pH7 or below, or with solvents such as tetrahydrofuran permits the use of lesser quantities of sodium hydroxide and/or chlorine dioxide to attain brightness and physical properties comparable to those of pulps treated by alkaline extraction at pH values greater than 10.

While the mechanism of action is not completely known and without limitation thereto it appears that peracetic acid reacts with chlorolignin in chlorinated Kraft pulp thereby activating the residual chlorolignin permitting easier removal from the pulp. Thus, less chlorine dioxide is required for further bleaching.

TABLE 8

| TEST NO. | BLEACHING SEQUENCE | CHEMICALS APPLIED AFTER $C_D$ STAGE, % ON PULP NaOH | $ClO_2$ | 1st EXTR. STAGE BRIGHTNESS, % GE | P # | FINAL STAGE BRIGHTNESS % GE (REVERTED) | VISCOSITY cP | HANDSHEET PROPERTIES (400 CSF) BREAKING LENGTH (km) | BURST FACTOR | TEAR FACTOR |
|---|---|---|---|---|---|---|---|---|---|---|
| 1. | $C_D$PaDED | 2.6 | 1.5 | 51.5 | 2.8 | 89.0 (85.6) | 22.6 | — | — | — |
| 2. | $C_D$(PaE)DED | 3.6 | 0.75–1.0 | 48.0 | 2.0 | 88.2 (86.2) | 23.8 | 12.2 | 91.7 | 84.7 |
| 3. | $C_DE_SDED$ | 0.6 | 1.5 | 49.0 | 2.1 | 89.6 (86.9) | 20.5 | 11.2 | 82.0 | 80.0 |
| 4. | $C_D$TDED | 0.6 | 2.0 | 42.0 | — | 88.6 (86.1) | 21.7 | 10.7 | 91.0 | 77.0 |
| 5[a] | $C_D$PaTDD | 2.0 | 1.5 | — | — | 85.5 | 23.1 | — | — | — |

TABLE 8-continued

| TEST NO. | BLEACHING SEQUENCE | CHEMICALS APPLIED AFTER $C_D$ STAGE, % ON PULP NaOH | $ClO_2$ | 1st EXTR. STAGE BRIGHTNESS, % GE | P # | FINAL STAGE BRIGHTNESS % GE (REVERTED) | VISCOSITY cP | HANDSHEET PROPERTIES (400 CSF) BREAKING LENGTH (km) | BURST FACTOR | TEAR FACTOR |
|---|---|---|---|---|---|---|---|---|---|---|
| 6. | $C_D$EDED | 4.1 | 1.5 | 37.6 | 3.0 | 88.6 (85.9) | 24.4 | 11.9 | 93.3 | 81.0 |

Notes for Table 8
Pa - Extraction with 0.5% peracetic acid, pH (initial/final) 6.5/4.5, 77° C., 2 hr, followed by hot water wash in Test No. 1 and by a mild alkaline extraction in Test No. 2. Wash between Pa and E stages is optional.
$E_S$ - Extraction with sodium sulfite (3–12%), 70–150° C., pH 7/5.
T - Extraction with tetrahydrofuran (21/100 g pulp). Chlorination temp. was 55° C. in Test Nos. 4 and 5 (30° C. in all other Tests). 9% $Cl_2$ on pulp. in Test No. 5, and 7% in other Tests.
[a]This test represents a fully nonalkaline sequence. A repeat of this bleaching experiment starting with 36 kappa pulp gave bleached pulp of brightness 85.8% GE, reverted brightness 81.6% GE, and viscosity 20.4.

EXAMPLE 8

Softwood kraft pulp, kappa No. 36, is bleached according to the bleaching sequences and under the conditions shown in Table 9. The results are tabulated therein. In the bleaching sequences shown, H represents a hypochlorite bleaching step.

EXAMPLE 9

Northern softwood kraft pulp (Kappa No. 30) was bleached by the sequences and under the conditions shown in Table 10. The results are tabulated therein. In the bleach sequences A represents the addition of mineral acid to adjust pH.

TABLE 9

| | $C_D$EHD (control) | $C_D$PaHD | $C_D$(PaE)* |
|---|---|---|---|
| 1st Stage | | | |
| % $Cl_2$/% $ClO_2$ | 0.225 × kappa/0.1 | | |
| Time, min/Temp. (°C.) | 60/30 | | |
| 2nd Stage | | | |
| Sodium Hydroxide, (%) | 3.5 | 2.0 | 3.5** |
| Peracetic Acid | 0.0 | 0.5 | 0.5 |
| Time, min/Temp. (°C.) | 90/77 | 90/77 | 90/77 30/70*** |
| pH Initial/Final | 12/11 | 7/5 | 7/5 12/11**** |
| Properties | | | |
| P. No. | 4.2 | 3.0 | 3.0 |
| Brightness (% GE) | 34.8 | 37.4 | 43.1 |
| 3rd Stage | | | |
| Sodium Hypochlorite | 1.7 | 1.7 | 1.7 |
| Time, min/Temp. (°C.) | 120/50 | 120/50 | 120/50 |
| pH Initial/Final | 11.2/9.5 | 11/8.2 | 11.3/9.4 |
| 4th Stage | | | |
| % $ClO_2$ | 0.5 | 0.5 | 0.5 |
| Time, min/Temp. (°C.) | 180/60 | 180/60 | 180/60 |
| Properties | | | |
| Brightness % GE (Reverted % GE) | 84.5 (82.3) | 84.3 (81.9) | 87.7 (85.2) |
| Viscosity (cP) | 20.1 | 17.2 | 17.2 |

Notes for Table 9
*No wash between Pa and E stages.
**2.0% NaOH in Pa stage, 15% NaOH in E stage.
***Initial two numbers represent time/temperature in Pa stage, second two numbers represent time/temperature in E stage.
****Initial two numbers represent pH values for Pa stage, second two numbers represent pH values for E stage.

TABLE 10

| | Control | | | | | |
|---|---|---|---|---|---|---|
| | $C_D$EDED (Conv.) | $C_D$E$C_D$ED | $C_D$A$C_D$ED | $C_D$Pa$C_D$ED | | |
| Sequence | 1 | 2 | 3 | 4 | 5 | 6 |
| Test No | | | | | | |
| 1st Stage | | | | | | |
| % $Cl_2$/% $ClO_2$ | | | 6.8/0.1 | | | |
| Temp. (°C.) Time, (min.) | | | 30/60 | | | |
| 2nd Stage (90 min, 70° C.) | | | | | | |
| Sodium Hydroxide, (%) | 3.5 | 3.5 | — | 2.0 | 2.0 | 2.0 |
| Peracetic Acid, (%) | — | — | — | 0.5 | 0.5 | 0.5 |
| Time, (min)/Temp (°C.) | 90/70 | 90/70 | 90/70 | 90/70 | 90/70 | 90/77 |
| pH On/Off | 11.6/10.8 | 11.6/10.8 | 5.5/5.5 | 7.5/5.3 | 7.5/5.3 | 7.2/4.8 |
| P. No. | 2.9 | 2.8 | — | 2.6 | 2.3 | — |
| Brightness (% G.E.) | 40 | 40 | — | 44 | 47 | — |
| 3rd Stage | | | | | | |

TABLE 10-continued

| | Control | | | | | |
|---|---|---|---|---|---|---|
| | $C_DEDED$ (Conv.) | $C_DEC_DED$ | $C_DAC_DED$ | $C_DPaC_DED$ | | |
| Sequence | 1 | 2 | 3 | 4 | 5 | 6 |
| % $Cl_2$ | — | 2.5 | 2.5 | 2.5 | 2.0 | 2.5 |
| % $ClO_2$ | 1.0 | 0.25 | 0.25 | 0.25 | 0.2 | 0.1 |
| Temp (°C.) Time, (min) | 60/180 | 50/60 | 50/60 | 50/60 | 35/60 | 50/60 |
| 4th Stage | | | | | | |
| Sodium Hydroxide, % | | | 0.6 | | | |
| Temp (°C.) Time, (min) | | | 70/90 | | | |
| % G.E. | 78 | 67 | 57 | 64 | 64 | 65 |
| 5th Stage | | | | | | |
| % $ClO_2$ | | | 0.5 | | | |
| Temp (°C.) Time, (min) | | | 60/180 | | | |
| Brightness (% G.E.) | 88.4 | 87.5 | 86.8 | 88.3 | 87.6 | 88.1 |
| Reverted Brightness (% G.E.) | 87.7 | 87.0 | 83.0 | 87.4 | 86.0 | 85.4 |
| Viscosity, (cP) | 24.3 | 20.9 | — | 18.9 | 22.1 | 17.5 |

EXAMPLE 10

Northern softwood kraft pulp after treatment with chlorine in the presence of chlorine dioxide is further treated as set forth in Table 11 under the conditions set forth therein to obtain the results shown.

TABLE 11

| Stage/Test No. | Control 1 | 2 | 3 | 4 | 5 |
|---|---|---|---|---|---|
| Pa % Pa applied/ % Pa Resid. | — | 0.5/0 | 0.5/0 | 1.25/19 | 1.25/19 |
| pH initial/pH final | — | 7.2/5.2 | 7.2/5.2 | 6.8/4.5 | 6.8/4.5 |
| Time (min) Temp. (°C.) Temp. (°C.) | — | 90/77 | 90/77 | 90/77 | 90/77 |
| Brightness (% GE) | — | 45.4 | — | 56.6 | — |
| P. No. viscosity | — | 5.4/25.6 | — | 2.5/25.0 | — |
| E % NaOH | 3.5 | — | 1.5 | — | 1.5 |
| Time, (min/Temp.) °C. | 90/70 | — | 30/70 | — | 30/70 |
| pH initial/pH final | 11.5/11.0 | — | 11.7/11.2 | — | 11.2/10.6 |
| Brightness (% GE) | 35 | — | 43.8 | — | 52.0 |
| P. No./Viscosity | 5.4/28.0 | — | 3.9/25.0 | — | 2.3/24.2 |
| D % $ClO_2$/% $ClO_2$ Resid | — | 1.0/2.6 | 1.0/3.1 | 1.0/3.5 | 1.0/3.9 |
| Time, min/Temp. °C. | — | 180/60 | 180/60 | 180/60 | 180/60 |
| pH on/pH off | — | 3.1 | 3.2 | 3.3 | 3.2 |
| Brightness (% GE)/ Reverted Brightness (% GE) | — | 62.4/56.0 | 78.2/71.4 | 76.6/70.4 | 83.3/78.8 |
| P. No./Viscosity | — | 1.5/24.2 | 1.1/23.8 | 1.4/22.3 | 0.9/23.4 |

| Stage/Test No. | Control 6 | 7 | 8 | 9 | 10 | 11 |
|---|---|---|---|---|---|---|
| Pa % Pa applied % Resid. | 2.0/20 | 2.0/20 | 3.0/25 | 4.0/26 | 5.0/32 | 10.0/45 |
| pH initial/ pH final | 6.7/4.0 | 6.7/4.0 | 7.3/4.8 | 7.0/4.8 | 7.5/5.0 | 7.1/4.5 |
| Time, (min)/ Temp °C. | 90/77 | 90/77 | 90/77 | 60/77 | 45/77 | 30/77 |
| Brightness (% GE)/ Rev. Bright. (% GE) | 70.5 | — | 82.4/69.0 | 82.8/66.5 | 83.4/69.5 | 83.7/67.5 |
| P. No./ Viscosity | 2.2/24.4 | — | 1.1/23.0 | 0.8/20.8 | 0.7/19.1 | 0.7/16.7 |
| E % NaOH | — | 1.5 | 1.5 | 1.5 | 1.5 | 1.5 |
| Time, (min) Temp (°C.) | — | 30/70 | 30/70 | 30/70 | 30/70 | 30/70 |
| pH initial/pH final | — | 10.9/10.4 | 11.6/10.4 | 11.7/10.4 | 11.6/10.3 | 11.8/10.4 |
| Brightness (% GE) | — | 62.3 | 74.2 | 73.3 | 75.2 | 75.1 |
| P. No./ Viscosity | — | 2.0/23.8 | 0.4/17.3 | 0.4/16.8 | 0.3/15.3 | 0.2/12.9 |
| D % $ClO_2$/% $ClO_2$ Resid | 1.0/3.9 | 1.0/4.0 | — | — | — | — |
| Time, (min)/ | 180/60 | 180/60 | — | — | — | — |

TABLE 11-continued

| | | | | | | |
|---|---|---|---|---|---|---|
| Temp (°C.) | | | | | | |
| pH final | 3.2 | 3.3 | — | — | — | — |
| Brightness (% GE)/ Rev. Bright. (% GE) | 80.8/76.3 | 84.6/79.2 | — | — | — | — |
| P. No./ Viscosity | 0.9/23.1 | 0.6/22.7 | — | — | — | — |

Notes for Table 11
*The Permanganate number 5.4 for the control $C_DE$ pulp indicates that the starting pulp was probably underchlorinated.
For pH adjustment in Pa stage, 2% NaOH applied in Nos. 2 & 3, and increasing amounts in Nos. 4–11.

EXAMPLE 12

Softwood pulp is bleached similarly to Example 4 but substituting sulfolane at 70° to 90° C. for 30 to 60 minutes for tetrahydrofuran to provide the sequence:

$C_D$[sulfolane] DED.

The bleached pulp had a GE brightness of 86.8%, viscosity 18.8 cp.

The subject matter which applicants regard as their invention is particularly pointed out and distinctly claimed as follows:

1. A process for bleaching kraft pulp comprising:
(a) treating an aqueous slurry of kraft pulp with a bleaching effective amount of chlorine and a cellulose protective amount of chlorine dioxide;
(b) extracting the pulp of step (a) above at an acidic pH and at a temperature range of from about 30° C. to about 77° C. with an effective amount of a chlorinated lignin solubilizing agent comprising an aqueous solution of a sulfite ion;
(c) treating the pulp from step (b) above with an effective amount of chlorine dioxide or sodium hypochlorite;
(d) extracting the pulp from step (c) above with an effective amount of an aqueous solution of an alkali metal hydroxide or a chlorinated lignin solubilizing agent as defined in step (b) above; and
(e) treating the pulp from step (d) above with an effective amount of chlorine dioxide.

2. A process as defined in claim 1 wherein the treatment in step (d) is with an aqueous solution of an alkali metal hydroxide.

3. A process as defined in claim 2 wherein the alkali metal hydroxide is sodium hydroxide.

4. A process as defined in claim 1 wherein the treatment in step (d) is with a chlorinated lignin solubilizing agent.

5. A process as defined in claim 1 wherein the aqueous solution of sulfite ion has a pH of from about 3 to about 5.

6. A process as defined in claim 5 wherein the aqueous solution of sulfite ion contains counter ions derived from sodium.

* * * * *